United States Patent [19]

Barrett

[11] Patent Number: 4,686,034

[45] Date of Patent: Aug. 11, 1987

[54] MAGNETIC REFUSE SEPARATOR

[75] Inventor: William T. Barrett, Waukesha, Wis.

[73] Assignee: Wehr Corporation, Milwaukee, Wis.

[21] Appl. No.: 904,774

[22] Filed: Sep. 5, 1986

Related U.S. Application Data

[63] Continuation of Ser. No. 732,907, May 9, 1985, abandoned, which is a continuation of Ser. No. 578,138, Feb. 8, 1984, abandoned, which is a continuation of Ser. No. 326,586, Dec. 2, 1981, abandoned.

[51] Int. Cl.[4] ..... B03C 1/22; B07C 9/00

[52] U.S. Cl. ..... 209/223.1; 209/226; 209/930

[58] Field of Search ..... 209/636, 645, 930, 213, 209/215, 223 R, 223.1, 225, 226, 228, 231; 198/690

[56] References Cited

U.S. PATENT DOCUMENTS

| | | | |
|---|---|---|---|
| 423,907 | 3/1890 | Conkling | 209/223 A |
| 463,305 | 11/1891 | Hoffman | 209/223 A |
| 765,013 | 7/1904 | King | 209/223 A |
| 905,815 | 12/1908 | Grondal | 209/223 A |
| 972,109 | 10/1910 | Holmberg | 209/223 A |
| 1,146,141 | 7/1915 | Dutton et al. | 209/223 A |
| 2,176,784 | 10/1939 | Bowden | 209/636 |
| 2,747,735 | 5/1956 | Palm | 209/223 R |
| 3,809,239 | 5/1974 | Barrett et al. | 209/636 |
| 3,935,947 | 2/1976 | Barrett | 209/636 |
| 4,051,023 | 9/1977 | Fogle et al. | 209/223 A |
| 4,055,489 | 10/1977 | Soley | 209/223 A |
| 4,125,191 | 11/1978 | Peace | 209/636 |

FOREIGN PATENT DOCUMENTS

| | | | |
|---|---|---|---|
| 4690 | of 1890 | United Kingdom | 209/223 A |

*Primary Examiner*—Robert B. Reeves
*Assistant Examiner*—Donald T. Hajec
*Attorney, Agent, or Firm*—Michael, Best & Friedrich

[57] ABSTRACT

A solid waste magnetic separator having a material transport belt, a mechanism for generating a magnetic field, and a mechanism for supporting the belt so magnetic materials can be attracted to the belt and transported therewith as the belt moves through the magnetic field. The magnetic field generating mechanism comprises at least two magnetic assemblies aligned relative to each other in the direction of travel of the belt. A ferromagnetic pole shoe is disposed between the belt and the magnetic assemblies, thereby creating a relatively uniform combined magnetic field along the magnetic assemblies so that heavy magnetic materials attracted to the belt remain attracted to the belt as the belt moves through the combined magnetic field.

18 Claims, 2 Drawing Figures

10
11
12
13
14
15
16
18
20
22
24
26
28
30
32
34
36
38
40
42
44
46
48
50
52
54
56
57
58
60
62

40
42
44
46
48
49
50
51
52
57
58

MAGNETIC REFUSE SEPARATOR

BACKGROUND OF THE INVENTION

This is a continuation of co-pending application Ser. No. 732,907, filed May 9, 1985, (now abandoned) which is a continuation of application Ser. No. 578,138, filed Feb. 8, 1984 (now abandoned), which in turn is a continuation of application Ser. No. 326,586, filed Dec. 2, 1981 (now abandoned).

This invention relates to magnetic separators and, more particularly, to magnetic separators for separating heavy magnetic materials from other materials in solid waste.

With more and more emphasis being placed on recycling, it is becoming more desirable to recover salvageable articles from otherwise discarded material. Much of the metallic material discarded as refuse can generally be recycled for one purpose or another, provided it can be efficiently separated from the remainder of the refuse. The metallic materials intended to be recaptured usually are generally also magnetic so that magnetic separation is a possibility for recapture. Heavy magnetic materials weighing several pounds (e.g. 8 pounds or more) present a special problem in that they are difficult to attract and retain magnetically attracted to a conveyor belt as the belt moves through a magnetic field generated by a plurality of magnetic assemblies.

The magnetic assemblies in prior magnetic separators typically are spaced or gapped and heavier materials tend to drop away from the belt at the gaps where there is non-uniformity in the magnetic field. For example, Barrett U.S. Pat. Nos. 3,809,239 and 3,935,947 disclose magnetic separators employing magnetic assemblies which are spaced and adjacent ones have opposite polarity.

Examples of other prior magnetic separators which do not produce a relatively uniform magnetic field of sufficient strength to upwardly attract and transport heavy magnetic materials along the length of a separator are disclosed in the following U.S. patents:

| Patentee | U.S. Pat. No. | Issue Date |
|---|---|---|
| Palm | 2,747,735 | May 29, 1956 |
| Hoffman | 463,305 | Nov. 17, 1891 |
| King | 765,013 | July 12, 1904 |
| Holmberg | 972,109 | Oct. 4, 1910 |
| Dutton, et al | 1,146,141 | July 13, 1915 |
| Grondal | 905,815 | Dec. 1, 1908 |

SUMMARY OF THE INVENTION

A principal object of the invention is to provide a magnetic separator which has a relatively uniform magnetic field along its length of sufficient strength to enable it to attract and then continue to attract heavy magnetic materials while they are transported along the length of the separator.

Another object of this invention is to provide a magnetic separator capable of segregating heavy magnetic materials from light magnetic materials after they have been separated from other refuse.

For the achievement of the above and other objectives, this invention provides a magnetic separator having a continuous belt moving past magnetic assemblies which generate a magnetic field through which the belt moves. Magnetic materials discharged in the area of the magnetic field are attracted to the belt and carried by the belt through the magnetic field.

The magnetic field is generated by at least two magnetic assemblies aligned relative to each other in the direction of belt travel. Each magnetic assembly has the same magnetic polarity near the belt. A ferromagnetic pole shoe is disposed between the belt and the magnetic assemblies and extends over the magnetic field generating portions (magnet cores) of the magnetic assemblies. The pole shoe causes the strength of the overall or combined magnetic fields of the magnetic assemblies to be relatively uniform along the length of the magnetic field generating means. As a result, heavy magnetic materials remain attracted to the belt as it moves through the combined field.

In another embodiment of this invention, a second magnetic field generating means is provided downstream from the first field generating means in the direction of travel of the belt. The second magnetic field generating means has an opposite polarity from the first field generating means and the pole shoe extends over the magnetic field generating portion of the second magnetic field generating means. The resulting overall or combined magnetic field is relatively uniform over the first magnetic field generating means and then diminishes before where the belt passes over the second magnetic field generating means.

If a means for switching the polarity of the second field generating means is added to this embodiment, and the second field generating means assumes the same polarity as the first means, all magnetic materials will be carried along the belt and released near the end of the pole shoe. When the polarity of the second generating means is opposite the first, however, the lesser strength of the magnetic field before the second magnetic field generating means causes heavier magnetic materials to fall away from the belt while lighter magnetic materials are reattracted to the belt. In this manner, heavy magnetic materials are segregated from lighter magnetic materials.

DESCRIPTION OF THE PREFERRED EMBODIMENT

Figure 1:
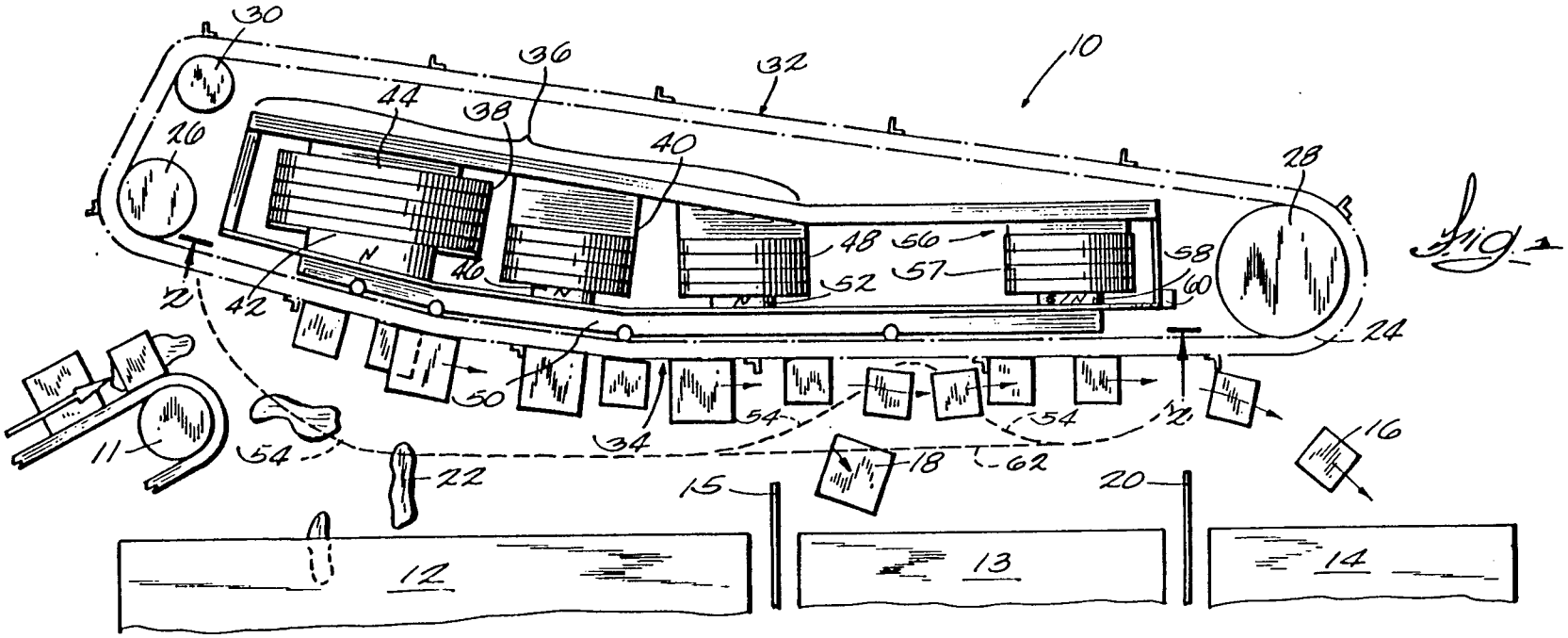
FIG. 1 is a side view of a combination supply conveyor and refuse separator partially in section.

With particular reference to the drawings, a refuse separator 10 is illustrated in combination with a supply conveyor 11, receptacles 12, 13, and 14 and splitter baffles 15 and 20. The function of the receptacles and splitter baffles is to physically segregate separated heavy magnetic 18, light magnetic 16 and non-magnetic material 22, therefore, no particular form of either is necessary. As will be discussed hereinafter, however, the location of the splitters is a factor to be considered in operation.

The refuse separator 10 is intended to receive refuse from the supply conveyor 11 and carry the magnetic portion of the refuse over the splitter baffle 15 while the non-magnetic material 22 falls, by reason of gravity, into the receptacle 12. To this end, the separator 10 includes a belt 24 which travels in a counterclockwise manner around a head pulley 26, an end pulley 28 and an idler roller 30 and has upper and lower generally horizontal extensions 32 and 34. The head pulley 26 is driven in a counterclockwise direction by a suitable drive mechanism (not shown) and the belt 24 is driven by the head pulley 26.

A magnetic arrangement is located within the area defined by the belt 24, i.e., above and near the lower portion or run of the belt 24. In this embodiment, the magnetic field generating means 36 consists of three magnetic assemblies, a first or upstream magnetic assembly 38, a second magnetic assembly 40 downstream of the first magnet 38 along the direction of travel of the belt, and a third magnetic assembly 48 immediately downstream of the second magnetic assembly 40 along the direction of travel of the belt. The first magnetic assembly 38 is in the form of an electromagnet having a central core 42 surrounded by an electrical coil 44. This is a conventional electromagnet construction and when the coil 44 is energized the end of core adjacent the belt 24 will assume a magnetic polarity, e.g. north. The first magnetic assembly 38 usually has a greater magnetic field than the other magnetic assemblies in order to initially attract the magnetic materials to the belt.

The second magnetic assembly 40 is also in the form of an electromagnet including a core 46 adjacent the belt 24 which assumes the same magnetic polarity as the first magnetic assembly. The third magnetic assembly 48 has the same magnetic polarity as the first and second magnetic assemblies.

It should be appreciated further that the entire magnetic field generating means 36 could be made of electromagnets or permanent magnets as desired, or a combination of permanent and electro. Electromagnets do afford a possible safety advantage when work must be done in the area of the separator in that they can be turned off and cleared of all material.

A pole shoe means 50, made of a ferromagnetic material such as iron, is disposed between the belt 24 and the magnetic assemblies and extends over the magnetic field generating portions, i.e., cores, 42, 46 and 52, of all three magnetic assemblies. The pole shoe 50 causes the magnetic fields generated by each of the magnetic assemblies to blend so the overall or combined magnetic field along the length of the field generating means 36 is relatively uniform, as illustrated by line 54 in FIG. 1 which is a graphical representation of the strength of the combined magnetic field. The combined magnetic field 54 causes magnetic materials attracted to the belt 24, including heavy magnetic materials 18, to remain attracted to the belt as it moves along the length of the field generating means 36.

Figure 2:
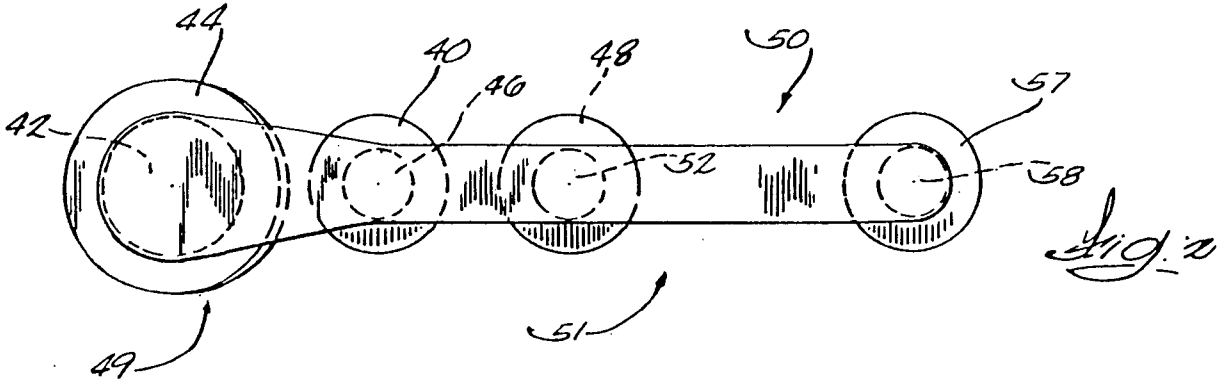
FIG. 2 is a view taken generally along line 2—2 in FIG. 1.

The pole shoe 50 can have a paddle-like shape as shown in FIG. 2. That is, the pole shoe 50 includes a wider section 49 in the vicinity of the first magnetic assembly 38 and a narrower section 51 otherwise. The shoe 50 is generally as wide as the cores of the various magentic assemblies, and has a thickness sufficient to permit the blending of the magnetic fields. Thus, as shown in FIGS. 1 and 2, the pole shoe 50 has an upstream end located adjacent and terminating beneath the end of the first or upstream magnetic assembly field generating portion or core 42 and having a shape generally conforming to the shape of the end of the first magnetic assembly field generating portion or core 42, and, downstream from the first magnetic assembly 38, the pole shoe 50 has a width generally conforming to the widths of the downstream field generating portions or cores 46 and 52. In the preferred embodiment, as shown in FIG. 2, the shape of the end of the first magnetic assembly field generating portion or core 42 is circular and the upstream end of the pole shoe 50 is circular.

In operation, the supply conveyor 11 carries refuse into the magnetic field 54 of the separator so magnetic material contained in the refuse is attracted to the belt 24 in the area of the first magnetic assembly 38. The non-magnetic material 22, such as paper, falls by gravity into a receptacle 12, and the magnetic material travels with the belt 24 beyond the splitter baffle 15.

Under circumstances where it is desirable to segregate the heavy magnetic materials 18, such as blocks of steel, from lighter magnetic materials 16, such as cans, the separator 10 further includes a second magnetic field generating means 56 downstream from the first field generating means 36 in the direction of the path of travel of the belt. The second field generating means 56 is a fourth or downstream magnetic assembly 57 including a core 58 and having a construction similar to the magnetic assemblies 38, 40, and 48, except that its polarity is opposite to the polarity of the three magnetic assemblies making up the first magnetic field generating means 36.

The pole shoe 50 extends over the core 58 of the fourth magnetic assembly 57 and has a downstream end terminating beneath the downstream magnetic assembly 57. By extending the pole shoe 50 into the magnetic field of this second field generating means 56 having the opposite polarity, e.g. south, the strength of the magnetic field along the length of the separator diminishes in the area of the second field generating means 56. By the time magnetic materials carried by the belt 24 reach the end of the first generating means 38, the resulting magnetic field is significantly diminished. In operation, heavy magnetic materials 18 carried by the belt 24 are released as the magnetic field starts to diminish near the second magnetic field generating means 56, and fall by gravity into the receptacle 13. Lighter magnetic materials 16 are released further along the path of the separator toward the end of the pole shoe 50 and fall by gravity into the receptacle 14. The splitter baffle 20 is located between the points where the heavy and lighter materials are released to facilitate their segregation.

Under certain circumstances, it may be desirable to allow either all magnetics to be carried the entire length of the pole shoe, or to have the heavier magnetics drop off first and then have the lighter magnetics drop off further along the length of the separator. This may be accomplished by having the invention include a switching means 60 for reversing the polarity of the second field generating means. When the polarity of the second field generating means assumes the polarity of the first field generating means, the separator will carry all magnetics the entire length of the pole shoe, provided the appropriate magnetic field strengths are used to assure a relatively uniform magnetic field along the length of the pole shoe. This uniform magnetic field is illustrated by line 62 in FIG. 1.

The idler roller 30, head pulley 26 and end pulley 28, together with both magnetic field generating means 36 and 56 and the pole shoe 50, are all supported from a common frame structure. A complete showing of the structural framework of the refuse separator is not necessary to understand this invention. The entire separator assembly can also be mounted for horizontal movement to permit adjustment of its position relative to the end of the supply conveyor 11, for example, like in the manner described in Barrett U.S. Pat. No. 3,809,239 which is incorporated herein by reference.

It is to be understood that the invention is not confined to the particular construction and arrangement of parts herein illustrated and described but embraces all such modified forms thereof as come within the scope of the following claims.

I claim:

1. A solid waste magnetic separator having a material transport belt, means for generating a magnetic field, and means for supporting said belt for movement through said magnetic field, said magnetic field generating means being characterized in that it comprises:

at least two magnetic assemblies having adjacent magnetic field generating portions of the same magnetic polarity located above and near a portion of said belt and aligned relative to each other in the direction of belt travel so that said belt and any magnetic materials attracted thereto pass sequentially through the magnetic fields generated by said magnetic assemblies, said assemblies including an upstream assembly an a downstream assembly, and ferromagnetic pole shoe means disposed between said belt and said magnetic assemblies and extending over the magnetic field generating portion of said magnetic assemblies so that said pole shoe means does not have a magnetic orientation of its own but assumes that induced in it by the magnetic assemblies and so that the combined magnetic field generated by said magnetic assemblies is relatively uniform along said belt and magnetic materials attracted to said belt remain attracted to said belt as it travels through said combined field, said pole shoe means having an upstream end terminating beneath said upstream assembly and a downstream end terminating beneath said downstream assembly.

2. A solid waste magnetic separator comprising a material transport belt, first and second means for generating a magnetic field, means for supporting said belt for movement through the magnetic fields generated by said first and second means, said first magnetic field generating means including at least two magnetic assemblies having adjacent magnetic field generating portions of the same magnetic polarity located near said belt and aligned relative to each other in the direction of belt travel so that said belt and any magnetic materials attracted thereto pass sequentially through the magnetic fields generated by said magnetic assemblies, said second magnetic field generating means being downstream from said first field generating means in the direction of travel of said belt, and said second field generating means comprising a magnetic assembly located near said belt and having a field generating portion which has a polarity opposite to that of said first field generating means, and ferromagnetic pole shoe means disposed between said belt and said magnetic assemblies of said first and second field generating means and extending over the magnetic field generating portion of said magnetic assemblies of said first field generating means so that the combined magnetic field generated by said magnetic assemblies of said first field generating means is relatively uniform along said belt and magnetic materials attracted to said belt remain attracted to said belt as it travels through said combined field, and said pole shoe means also extending to a point between said belt and the magnetic field generating portion of said second field generating means so that the strength of the magnetic field between said second magnetic field generating means and said first magnetic field generating means is signficantly diminished, so that heavier magnetic materials carried by said belt are released from said belt as it approaches said second magnetic field generating means and lighter magnetic materials are carried by said belt until near the end of said pole shoe means.

3. The magnetic separator in claim 2 and further comprising means for reversing the polarity of said second magnetic field generating means so that when the polarity of said second field generating means is the same as the polarity of said first field generating means the combined magnetic field remains relatively uniform along said belt so all magnetic materials are attracted to said belt and remain attracted to said belt as it travels through said combined field.

4. The magnetic separator in claim 3 wherein the magnetic field generating portion of the first of said magnetic assemblies along the path of belt travel has an end adjacent to and facing said belt and having a shape, the field generating portion of the other of said magnetic assemblies downstream from said first magnetic assembly has a width, said pole shoe means has an end located adjacent said end of said first magnetic assembly field generating portion and having a shape generally conforming to the shape of said end of said first magnetic assembly field generating portion, and said pole shoe means downstream from said first magnetic assembly has a width generally conforming to the widths of said downstream field generating portions, said widths being in a plane generally parallel to the path of belt travel.

5. The magnetic separator in claim 4 wherein the shape of said end of said first magnetic assembly field generating portion is circular and said end of said pole shoe means is circular.

6. The magnetic separator in claim 4 wherein said first magnetic assembly field generating portion is larger than the field generating portion of the other of said magnetic assemblies in order to attract magnetic materials to said belt and said pole shoe means has an increased width adjacent said first magnetic field generating portion.

7. The magnetic separator in claim 4 wherein the field generating portion of said second field generating means has an end adjacent to and facing said belt and having a shape and said pole shoe means has a second end having a shape generally conforming to the shape of said end of said field generating portion of said second field generating means.

8. A solid waste magnetic separator comprising a material transport belt, first and second means for generating a magnetic field, means for supporting said belt for movement through the magnetic fields generated by said first and second means, said first magnetic field generating means including a first mgnetic assembly having a magnetic field generating portion located near said belt, said second magnetic field generating means including a second magnetic assembly having a magnetic field generating portion located near said belt and having reversible polarity, and said second field generating means being downstream from first field generating means in the direction of belt travel so that said belt and any magnetic materials attracted thereto pass sequentially through the magnetic fields generated by said first and second magnetic assemblies, ferromagnetic pole shoe means disposed between said belt and said first and second magnetic assemblies and extending over the magnetic field generating portions of said first and second magnetic assemblies, and means for reversing the polarity of said second magnetic assembly so that, when the polarity of said second magnetic assembly is opposite to that of said first magnetic assembly, the strength of the mgnetic field between said first and second magnetic assemblies is significantly diminished so that heavier magnetic materials carried by said belt are released from said belt as it approaches said second magnetic assembly and lighter magnetic materials are carried by said belt until near the end of said pole shoe means, and so that, when the polarity of said second magnetic assembly is the same as that of said first magnetic assembly, the combined magnetic field remains relatively uniform along said belt so that all magnetic materials carried by said belt remain attracted to said belt as it travels through said combined field.

9. The magnetic separator in claim 8 wherein the magnetic field generating portion of the first of said magnetic assemblies along the path of belt travel has an end adjacent to and facing said belt and having a shape, the field generating portion of the other of said magnetic assemblies downstream from said first magnetic assembly has a width, said pole shoe means has an end having a shape generally conforming to the shape of said end of said first magnetic assembly field generating portion, and said pole shoe means downstream from said first magnetic assembly has a width generally conforming to the widths of said downstream field generating portions, said widths being in a plane generally parallel to the path of belt travel.

10. The magnetic separator in claim 9 wherein the shape of said end of said first magnetic assembly field generating portion is circular and said end of said pole shoe means is circular.

11. The magnetic separator in claim 9 wherein said first magnetic assembly field generating portion is larger than the field generating portion of the other of said magnetic materials to said belt and said pole shoe means has an increased width adjacent said first magnetic assembly field generating portion.

12. The magnetic separator in claim 9 wherein the field generating portion of said second field generating means has an end adjacent to and facing said belt and having a shape and said pole shoe means has a second end having a shape generally conforming to the shape of said end of said field generating portion of said second field generating means.

13. A solid waste magnetic separator comprising a material transport belt, means for generating a magnetic field, means for supporting said belt for movement through said magnetic field, said magnetic field generating means including at least two magnetic assemblies having adjacent magnetic field generating portions of the same magnetic polarity located near said belt and aligned relative to each other in the direction of belt travel so that said belt and any magnetic materials attracted thereto pass sequentially through the magnetic fields generated by said magnetic assemblies, the magnetic field generating portion of the first of said magnetic assemblies along the path of belt travel having an end adjacent to and facing said belt and having a shape, and the other field generating portions of the other magnetic assemblies downstream from said first magnetic assembly having widths in a plane generally parallel to the path of belt travel, and ferromagnetic pole shoe means disposed between said belt and said magnetic assemblies and extending over the magnetic field generating portions of said magnetic assemblies so that the combined magnetic field generated by said magnetic assemblies is relatively uniform along said belt and magnetic materials attracted to said belt remain attracted to said belt as it travels through said combined field, said pole shoe means having an end located at said end of said first magnetic assembly field generating portion and having a shape conforming to the shape of said end of said first magnetic assembly field generating portion, and said pole shoe means downstream from said first magnetic assembly having a width generally conforming to the width of said downstream field generating portions.

14. The magnetic separator in claim 13 wherein the shape of said end of said first magnetic assembly field generating portion is circular and said end of said pole shoe means is circular.

15. The magnetic separator in claim 13 wherein said first magnetic assembly field generating portion is stronger than the field generating portions of the other magnetic assemblies in order to attract magnetic materials to said belt and said pole shoe means has an increased width adjacent said first magnetic assembly field generating portion.

16. The magnetic separator in claim 13 wherein one of said other field generating portions has an end adjacent to and facing said belt and having a shape and said pole shoe means has a second end having a shape generally conforming to the shape of said end of said field generating portion of said second field generating means.

17. A solid waste magnetic separator comprising a material transport belt, means for generating a magnetic field, means for supporting said belt for movement through said magnetic field, said magnetic field generating means including at least two magnetic assemblies having adjacent magnetic field generating portions of the same magnetic polarity located near said belt and aligned relative to each other in the direction of belt travel so that said belt and any magnetic materials attracted thereto pass sequentially through the magetic fields generated by said magnetic assemblies, the magnetic field generating portion of the first of said magnetic assemblies along the path of belt travel having an end adjacent to and facing said belt and having a circular shape, and the other field generating portions of the other magnetic assemblies downstream from said first magnetic assembly having widths in a plane generally parallel to the path of belt travel, and ferromagnetic pole shoe means disposed between said belt and said magnetic assemblies and extending over the magnetic field generating portions of said magnetic assemblies so that the combined magnetic field generated by said magnetic assemblies is relatively uniform along said belt and magnetic materials attracted to said belt remain attracted to said belt as it travels through said combined field, said pole shoe means having an end located adjacent said end of said first magnetic assembly field generating portion and having a circular shape generally conforming to the circular shape of said end of said first magnetic assembly field generating portion, and said pole shoe means downstream from said first magnetic assembly having a width generally conforming to the widths of said downstream field generating portions.

18. A solid waste magnetic separator comprising a material transport belt, means for generating a magnetic field, means for supporting said belt for movement through said magnetic field, said magnetic field generating means including at least two magnetic assemblies having adjacent magnetic field generating portions of the same magnetic polarity located near said belt and aligned relative to each other in the direction of belt travel so that said belt and any magnetic materials attracted thereto pass sequentially through the magnetic fields generated by said magnetic assemblies, the magnetic field generating portion of the first of said magnetic assemblies along the path of belt travel having an end adjacent to and facing said belt and having a shape, and the other field generating portions of the other magnetic assemblies downstream from said first magnetic assembly having widths in a plane generally parallel to the path of belt travel, and said first magnetic assembly field generating portion being stronger than the field generating portions of the other magnetic assemblies in order to attract magnetic materials to said belt, and ferromagnetic pole shoe means disposed between said belt and said magnetic assemblies and extending over the magnetic field generating portions of said magnetic assemblies so that the combined magnetic field generated by said magnetic assemblies is relatively uniform along said belt and magnetic materials attracted to said belt remain attracted to said belt as it travels through said combined field, said pole shoe means having an end located adjacent said end of said first magnetic assembly field generating portion, said end of said pole shoe means having a shape generally conforming to the shape of said end of said first magnetic assembly field generating portion, said pole shoe means downstream from said first magnetic assembly having a width generally conforming to the widths of said downstream field generating portions, and said pole shoe means having an increased width adjacent said first magnetic assembly field generating portion.

* * * * *